US006196702B1

(12) United States Patent
Krietzman

(10) Patent No.: US 6,196,702 B1
(45) **Date of Patent: *Mar. 6, 2001**

(54) LASER LIGHT

(76) Inventor: Mark Howard Krietzman, 25550 Hawthorne Blvd., Suite 101, Torrance, CA (US) 90505

( * ) Notice: Subject to any disclaimer, the term of this patent is extended or adjusted under 35 U.S.C. 154(b) by 0 days.

This patent is subject to a terminal disclaimer.

(21) Appl. No.: 09/273,366

(22) Filed: Mar. 22, 1999

Related U.S. Application Data

(63) Continuation of application No. 08/918,514, filed on Aug. 21, 1997, now Pat. No. 6,062,702

(60) Provisional application No. 60/052,826, filed on Jul. 17, 1997, and provisional application No. 60/043,192, filed on Apr. 16, 1997.

(51) Int. Cl.[7] ..... F21L 4/00

(52) U.S. Cl. ..... 362/259; 362/158; 362/184; 362/231; 362/322; 362/110

(58) Field of Search ..... 362/259, 230, 362/231, 293, 184, 319, 322, 277, 282, 158, 110

(56) References Cited

U.S. PATENT DOCUMENTS

| | | | | |
|---|---|---|---|---|
| 3,976,986 | | 8/1976 | Zabroski . | |
| 4,680,682 | | 7/1987 | Parker . | |
| 4,803,605 | * | 2/1989 | Schaller et al. | 362/184 |
| 4,947,291 | * | 8/1990 | McDermott | 362/231 |
| 5,056,097 | * | 10/1991 | Meyers | 372/38 |
| 5,336,977 | | 8/1994 | Li . | |
| 5,343,376 | | 8/1994 | Huang . | |
| 5,349,506 | | 9/1994 | Maglica . | |
| 5,349,507 | | 9/1994 | Paker . | |
| 5,359,779 | * | 11/1994 | Polk et al. | 362/184 |
| 5,685,636 | * | 11/1997 | German | 362/259 |

* cited by examiner

*Primary Examiner*—Thomas M. Sember
(74) *Attorney, Agent, or Firm*—Mark Krietzman

(57) ABSTRACT

A novel hand held waterproof or submersible laser illumination device which provides for prolonged precise controlled illumination. The present invention also provides for a combination generalized illumination and selectable precise laser outputs.

12 Claims, 3 Drawing Sheets

49
51
56
150b
41b
41a
150a
65
40
150
41
157
156
200
202
206
102
153
103
155
101
48
100
43
47
42
210
205
204
203
104
52
64k
50
64a
105
20
57
58
59
44
45
61
60
62
63
154
A
64b
64c
64d
64e
64f
64g
64h
64i
64j
201

LASER LIGHT

RELATED APPLICATIONS

This application is a continuation of application Ser. No. 08/918,514, entitled "LASER LIGHT," filed on Aug. 21, 1997 U.S. Pat. No. 6,062,702 by Mark H. Krietzman, which application claims the benefit under 35 U.S.C. §119(e) of provisional Application Serial No. 60/043,192, entitled "LASER FLASHLIGHT WITH SELECTABLE OUTPUT," filed Apr. 16, 1997 by Mark H. Krietzman, and of provisional Application Serial No. 60/052,826, entitled "MULTI-PURPOSE FLASHLIGHT AND LASER ILLUMINATOR," filed Jul. 17, 1997, by Mark H. Krietzman, which applications are incorporated by reference herein.

BACKGROUND OF THE INVENTION

1. Technical Field of the Invention

This present invention relates to hand held lighting devices, and more particularly to a novel hand held waterproof or submersible laser light and laser flashlight, for illumination, communication, targeting, presentations, and measurement.

2. Background

Those experienced with diving will recall that inexpensive underwater communication is normally a combination of writing tablets, hand signals and nods. Watertight flashlights may solve some problems but do not provide the precise highly visible illumination and communication a submersible laser emitting illuminator yields.

Watertight flashlights are useful to ensure the integrity and reliability of operation in wet and harsh environments. In the underwater environment the users ability to see clearly, communicate verbally, and dexterity are limited by the breathing equipment and the dampening effect of the water. Also, often in non-underwater environments verbal communication may be restricted or limited.

A submersible laser light is visible in day and night situations and enhances a divers ability to communicate. Providing selectable laser outputs further enhances clear communication and illumination.

In both diving and non-diving situations a flashlight which produces both a general area of illumination and a precise controlled laser illumination would be useful.

The present invention provides a novel illumination system for prolonged precise selectable laser communication and precise controlled laser illumination. The present invention also provides for a combination generalized illumination and precise laser illumination.

SUMMARY OF INVENTION

Accordingly, it is an object of the invention to provide a novel hand held laser light.

It is yet another object of the invention to provide a novel hand held submersible laser light.

It is yet another object of the invention to provide a novel hand held submersible laser illuminator which can transmit a narrow focused output, underwater, to activate a remote wavelength specific submersible photoactive sensor with audible output.

It is yet another object of the invention to provide a novel hand held submersible laser light with selectable diffuse output.

It is yet another object of the invention to provide a novel hand held submersible laser light with selectable pattern output.

It is yet another object of the invention to provide a novel hand held submersible flashlight and laser light.

It is yet another object of the invention to provide a novel hand held flashlight and laser light.

It is yet another object of the invention to provide a novel hand held all weather flashlight and laser light.

It is yet another object of the invention to provide a novel hand held submersible flashlight and laser light with selectable diffuse laser output.

It is yet another object of the invention to provide a novel hand held submersible flashlight and laser light with selectable pattern laser output.

The features of the invention believed to be novel are set forth with particularity in the appended claims. The invention itself, however, both as to configuration, and method of operation, and the advantages thereof, may be best understood by reference to the following descriptions taken in conjunction with the accompanying drawings.

MODES FOR CARRYING OUT THE INVENTION

Figure 1A:
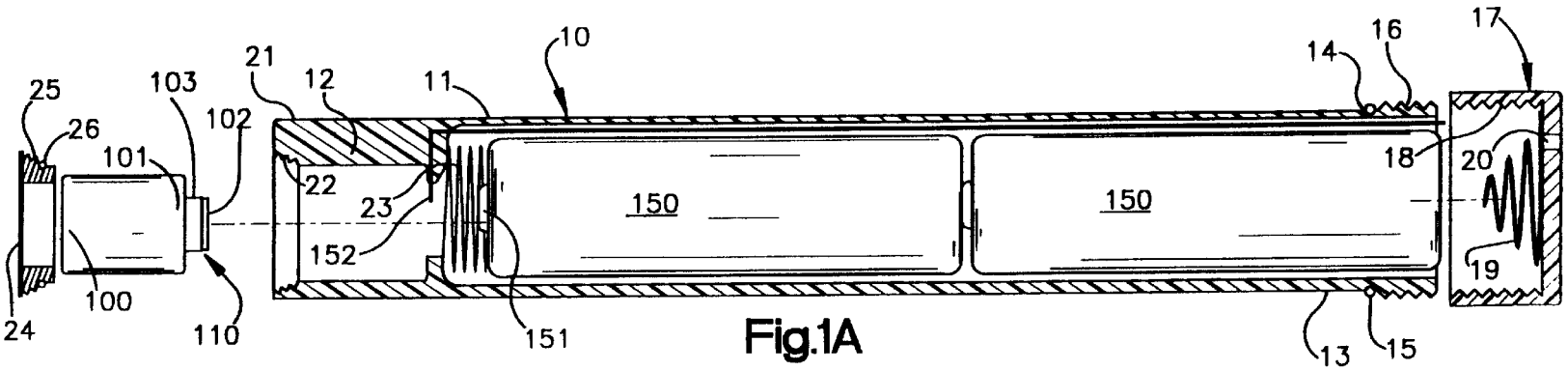
FIG. 1A illustrates a cut-away side assembly view of the preferred embodiment of the laser light.

Referring now to the drawings, there is illustrated in FIG. 1A a cut-away assembly side view of the preferred embodiment of the laser light generally designated 10.

The generally tubular housing 11 is of a size and shape which allows the insertion of one or more removable batteries 150, a solid state laser diode 100, (held in place within a circular diode guide 12 formed within the housing), and a front spacing spring 151 for controlling battery 150 contact with the laser emitting diode 100.

The batteries 150 are inserted into the rear of the housing 13. The outer wall of the rear of the housing 13 is circularly groved 14 to secure a rubber or silicone O-ring 15 firmly in place and has circular coarse threads 16. An end cap 17 with internal threads 18 corresponding to the course threads 16 is screwed on to the housing 13 over the O-ring 15 to seal the device 10. The rear-cap 17 also contains a contact spring 19 for controlling battery 150 contact with the laser emitting diode 100 and a one-way pressure relief valve 20 to vent battery 150 gases.

At the front end of the housing 21, the diode guide 12 is internally threaded 22. The diode guide 12 abuts a diode stop 23 which is used to inhibit rearward movement of the laser emitting diode 100.

The laser emitting diode 100 is readily available and is known art. The diode comprises a laser beam module with a control circuit. Since the laser emitting diode is well known in the art, it is unnecessary to present a detailed statement of its construction in the present invention.

For the preferred embodiment a laser emitting source in the visible range is used. The most compact source is a solid-state diode in the 532–690 nm range. Diode-pumped, CW diode, Q-switched diode, solid-state, solid-state CW, solid-state Q-switched, gas, dye, ion, or rare-earth element laser emitting sources may be used in place of the solid state diode when appropriate for the intended usage. For surveillance uses, search and rescue or other applications which use night vision or machine vision coupled with a non-visible spectrum illumination a laser emitting diode in the x-ray, ultraviolet or infrared spectrum may be substituted for the visible spectrum laser emitting diode.

Extending from the rear 101 of the laser emitting is a first conductive contact 102 and a second conductive contact 103 both affixed to a cylindrical contact neck 110. Within the housing 11 a rear contact strip 152 of a conductive material is affixed axially within the device.

To seal the diode 100 within the housing 11 and allow the light emitted therefrom to exit the housing 11 a transparent lens cap 24 is provided. The transparent lens cap 24 is finely threaded 25 to match the threads 22 provided within the diode guide 12 and is also circularly groved (not shown) to secure a front 0-ring 26. When screwed into the diode guide 12 the transparent lens cap 24 and O-ring 26 form a watertight seal.

Figure 1B:
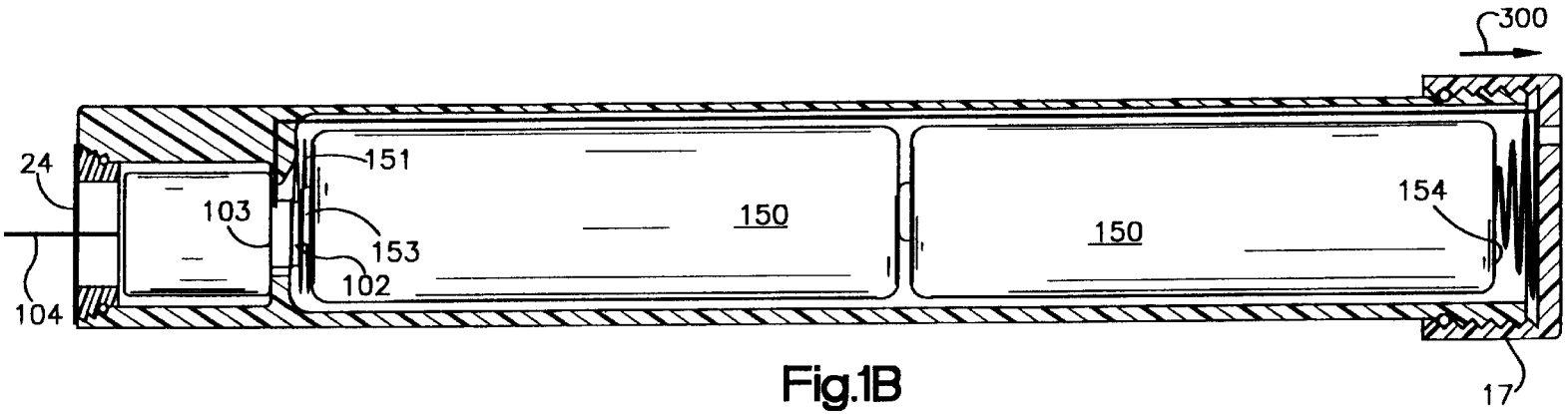
FIG. 1B illustrates a cut-away side view of the preferred embodiment of the laser light.

Referring now to FIG. 1B, there is illustrated a cut-away side view of the assembled preferred embodiment of the laser light generally designated 10.

The assembled device 10 is shown in the on position. The laser emitting diodes second contact 103 is firmly against the front battery terminal 153. The rear battery terminal 154 is in contact with the rear contact spring which connects to the rear contact strip which is in contact with the laser emitting diodes first contact 102 thereby completing the circuit which provides current to the diode which produces the laser output 104. The laser output 104 exits the device 10 via the transparent lens 24. To stop the flow of current to the laser emitting diode 100 the end cap 17 may be rotated counter-clockwise which causes it to unscrew along the line of arrow 300 and release the compression on the front spacing spring 151 thereby breaking the contact between the front battery terminal 153 and the laser emitting diodes first contact 102.

Figure 2A:
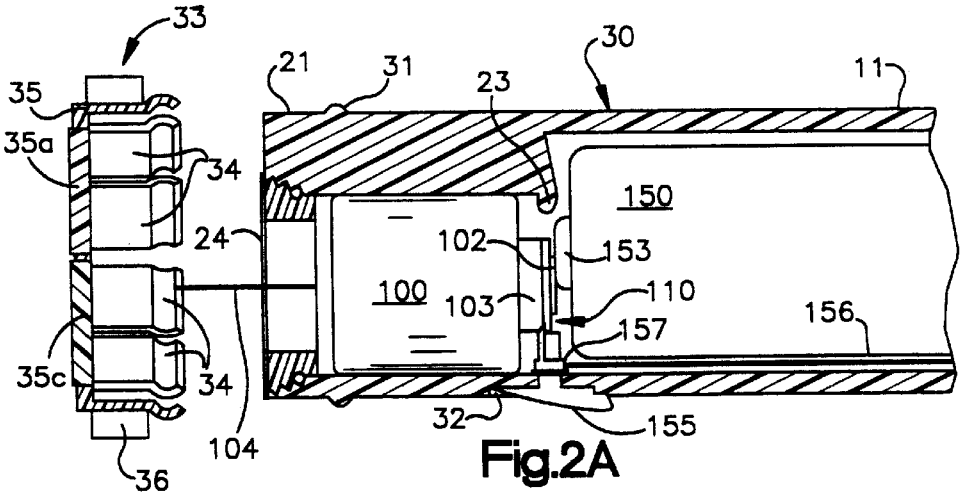
FIG. 2A illustrates a partial, cut-away side assembly view of an alternate embodiment of the laser light with overlens.

Referring now to FIG. 2A, there is illustrated a cut-away partial side assembly view of an alternate embodiment of the laser light generally designated 30.

The device 30 is constructed around the tubular housing 11 of the preferred embodiment. Formed as part of the housing 11 are a plurality of overlens guides 31 and a momentary switch guide 32.

The interchangeable overlens assembly 33 rotatably snaps over the overlens guides 31 and encases the front of the laser light 21. A plurality of perpendicular legs 34 extending around the circumference of the overlens face 35 are of a size and shape which removably and rotatably snap over the overlens guides 31. The overlens face 35 is constructed of a material which allows the passage and shaping of the laser output 104. Within the face of the overlens 35 are a series of discreet lens elements 35*a* & 35*c*. The discreet elements are positioned in-line with the laser output 104 which, passes from the diode 100 through the transparent lens 24. Not shown is the complete simple electrical circuit supplying current to the diode which is known art.

The wavelength specific laser output 104 may be diffused or formed into a wide variety and type of shapes and patterns specific to the characteristics of the discreet elements, partially shown, 35*a* & 35*c*. The exact degree of pattern forming or diffusion of the output is dependent on the intended use.

Material choice for the discreet elements 35*a* & 35*c* include convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers all yield controllable and selectable results.

For the present device 30 a series of diffusion elements and pattern generating gratings form the parts of the overlens face 35. To cause the laser output 104 to pass through a selected discreet element the overlens 35 may be rotated around the overlens guides 31 in line with the laser output 104.

Within the roughly cylindrical housing 11 a solid state laser emitting diode 100 is affixed. Current from the removable batteries 150 is supplied to the laser emitting diode 100 via the diodes first 102 and second 103 conductive contacts both affixed to a cylindrical contact neck 110. The front terminal of the battery 153 is in contact with the diodes first contact 102. A rotating momentary switch 155 is sealed within the switch guide 32 which traverses from the exterior to the interior of the device 30. Not shown is the rear of the device 30 and the rear terminal of the battery, the end cap, or the contact spring. The rear terminal of the batteries (not shown) is attached to the rotating momentary switch 155 via a conductive strip 156 which contacts the conductive member 157 of the rotating momentary switch 155. The conductive member can be rotated into contact with the diodes second contact 103 to complete a circuit. It is envisioned that other types of switches, momentary switches, spring loaded switches and locking switches well known in the art may be used.

Figure 2B:
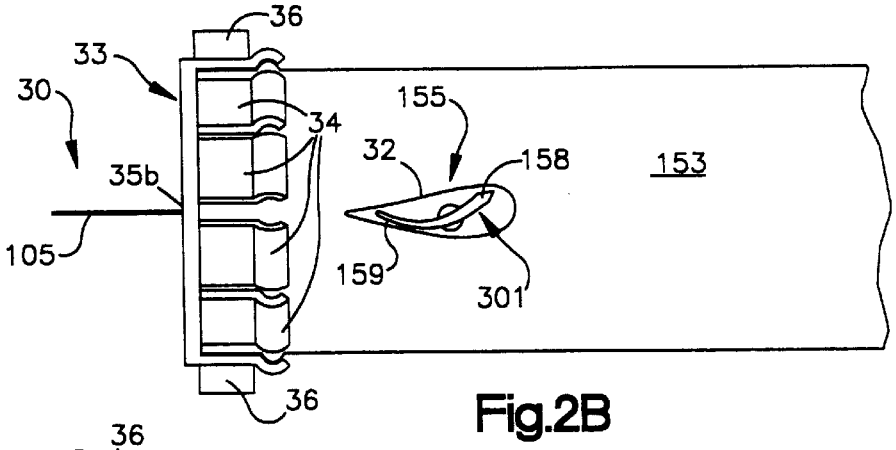
FIG. 2B illustrates a partial, top view of the embodiment of FIG. 2A assembled.

Referring now FIG. 2B, there is illustrated an assembled partial top view of the embodiment of FIG. 2A, generally designated 30.

The assembled device 30 is shown in the on position. The rotating momentary switch 155 is activated by pressure applied at the finger grip 158 along the line of arrow 301, the flexible spring end 159 is secured within the switch guide 32 and distorts in a reciprocal response to the pressure being applied. Not shown is the rotation of the conductive member 156 within the device 30 and the connection with the diodes second contact. When the pressure is released the flexible spring end 159 will be undistorted and the rotating momentary switch 155 will return to the off position.

The enhanced laser output 105 is shown after its passage from the laser emitting diode 100 through a selected discreet element of the overlens 35*b*. To increase ease of rotation of the overlens for selecting a discreet element 35 ribs 36 may be extended from outer wall of one or more of the perpendicular legs 34.

Figure 2C:
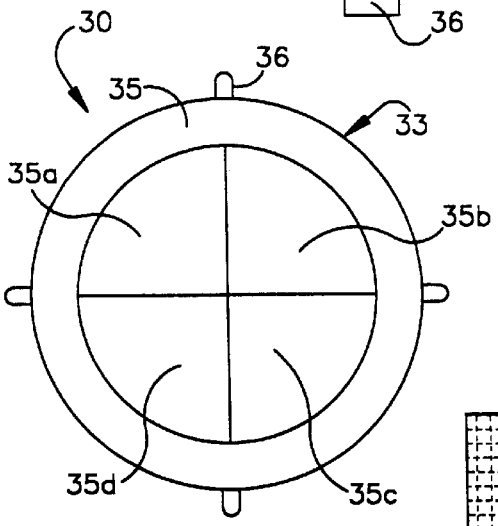
FIG. 2C illustrates a front view of FIG. 2B.

Referring now to FIG. 2C, there is illustrated a front view of the embodiment of FIG. 2B generally designated 30.

The face 35 of the overlens 33 is divided into a plurality of discreet elements 35*a–d* and each element has distinct diffusion and pattern generating characteristics. The ribs 36 positioned around the overlens 33 provide for ease of griping and rotation.

Figure 2D:
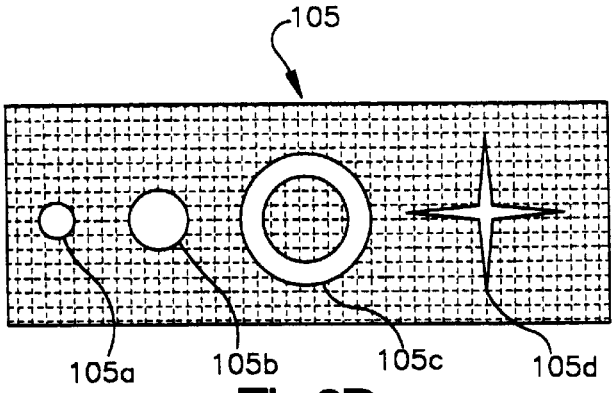
FIG. 2D illustrates a front view of the selectable output of FIG. 2C.

Referring now to FIG. 2D, a front view of the selectable output of FIG. 2C, generally designated 105.

The small output 105*a* is a diffuse spot with a fan angle of between 0.1 and 1 degree. The large output 105*b* is a diffuse spot with a fan angle of between 1.01 and 5 degrees. The hoop output 105*c* is with a non-illuminated center results from passing the laser output 104 through a pattern generating grating. The cross hair output 105*d* also results from passing the laser output 104 through a pattern generating grating. The patterns shown are for illustration purposes only and are not intended to be a limitation on the possible patterns and pattern combinations which may be generated by the device 30.

Figures 3A, 3B, 3C:
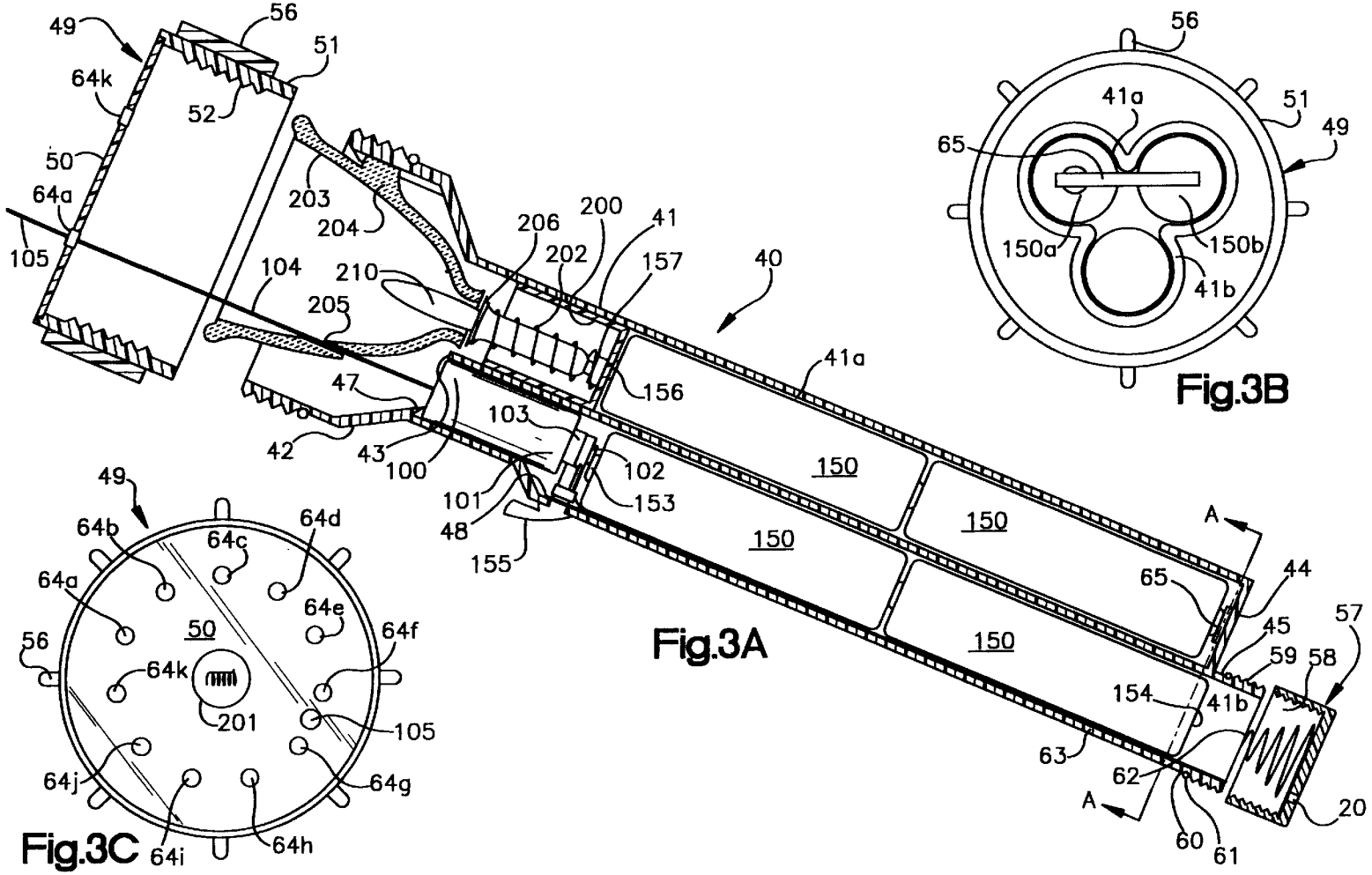
FIG. 3A illustrates a partial, cut-away side assembly view of the preferred embodiment of a wide spectrum flashlight with laser light.
FIG. 3B illustrates a cut-away rear view of the embodiment of FIG. 3A, at line A—A.
FIG. 3C illustrates a front view of the embodiment of FIG. 3A.

Referring now to FIG. 3A, there is illustrated a cut-away side assembly view of the preferred embodiment of a laser flashlight generally designated 40.

The device 40 is constructed around the generally tubular housing 41, with an enlarged front 42 and an internal axial center divider 43, which divides the housing 41 into an upper chamber 41*a* and a lower chamber 41*b*. The upper chamber has a sealed rear end 44 and the lower chamber has an open rear end 45. Both upper and lower chambers merge into the enlarged front 42.

The upper chamber 41*a* contains the flashlight components, electrical circuit and batteries. The lower chamber 41*b* contains the laser components, electrical circuit and batteries.

The laser emitting diode 100 is readily available and is known art. The diode comprises a laser beam module with a control circuit. Since the laser emitting diode is well known in the art, it is unnecessary to present a detailed statement of its construction in the present invention.

For the preferred embodiment a laser emitting source in the visible range is used. The most compact source is a solid-state diode in the 532–690 nm range. Diode-pumped, CW diode, Q-switched diode, solid-state, solid-state CW, solid-state Q-switched, gas, dye, ion, or rare-earth element laser emitting sources may be used in place of the solid state diode when appropriate for the intended usage. For surveillance uses, search and rescue or other applications which use night vision or machine vision coupled with a non-visible spectrum illumination a laser emitting diode in the x-ray, ultraviolet or infrared spectrum may be substituted for the visible spectrum laser emitting diode.

For the light component construction of the laser flashlight a plurality of batteries 150, a light bulb guide 200, a light bulb 201, a spacer spring 202, and a reflector dish 203 are removably inserted into the upper chamber 41*a* through the enlarged front 42. Formed as part of the reflector dish 203 is a stabilizer 204 which corresponds to the stabilizer guide slot 46 formed axially in the interior surface of the wall forming the enlarged front 42. The combination stabilizer 204 and stabilizer guide slot 46 restrict entry of the reflector dish 203 to one orientation and prevent rotation.

For the laser component construction of the laser flashlight, a laser emitting diode 100 is also mounted in the housing 41 through the enlarged front 42. The rear of the laser diode 101 is affixed into the lower chamber 41*b* via a flexible one-way locking tab 47 which extends perpendicular from the inner wall of the lower chamber 41*b* adjacent to the enlarged front 42. The one-way locking tab 47 will flex and distort to allow passage of the diode 100 into the lower chamber 41*b*. Once fully inserted the locking tab 47 will spring back and prevent the diode 100 from sliding forward.

To inhibit rearward movement of the laser emitting diode 100 a rotating momentary switch 155 is inserted and sealed within the switch guide 48 through the outer wall of the lower chamber 41*b* and behind the rear 101 of the laser emitting diode. The rotating momentary switch 155 is of a size and shape to both make positive contact with the diodes first and second set of conductive contacts 102 & 103 and restrict rearward movement of the diode.

A watertight and removable lens cover 49 is removably mounted over the enlarged front 42 of the housing 41 to seal the upper chamber and components. The lens cover 49 is cup shaped with a transparent planar face 50 and an annular circular wall 51 extends towards the enlarged front 42. The lens cover 49 is internally threaded with lens cover threads 52 corresponding to the externally threaded 53 enlarged front 42.

To create the watertight seal a large O-ring groove 54 is formed on the external surface of the enlarged front 42 and a large rubber or silicone O-ring 55 is affixed snugly within the large O-ring groove 54. The lens cover 49 is attached to the enlarge front 42 by screwing it on. To simplify rotation and prevent slippage of a hand on the lens cover 49 a plurality of raised ribs 56 are formed around the outer surface of the annular circular wall 51.

One or more batteries 150 supplying current to the laser emitting diode 100 are inserted through the open rear end 45 of the lower chamber 41*b*. The lower chamber is sealed by the lower chamber end cap 57 which has internal end cap threads 58 corresponding to the external housing threads 59 formed around the rear end 45 of the lower chamber 41*b*.

Also formed within the end cap 57 is a one-way pressure valve 20 which allows any gases generated by the batteries or diode to escape while preventing intrusion of water. A watertight seal is formed between the outer surface of the rear end 45 of the lower chamber 41*b* and the end cap 47 via a small O-ring groove 60 containing a small rubber or silicone O-ring 61. The lower chamber end cap 57 is attached by rotating it in a clockwise fashion over the rear end 45 of the lower chamber 41*b*.

The circuit supplying current to the diode is formed by screwing on the lower chamber end cap 57 which in-turn causes the conductive diode power spring 62 to contact with and urge the battery forward creating a positive contact between the diodes first contact 102 and the battery front terminal 153. To complete the circuit the conductive diode power strip 63 connects the rear battery terminal 154 with the rotating momentary switch 155.

The laser diode 100 may be activated independently or in concert with the light bulb 201. When active, the laser output 104 passes from behind the reflector dish 203 through a laser beam guide 205, of a size and orientation to allow unrestricted passage of the laser output 10, then through the transparent planar face 50 of the lens cover 49.

To generate an enhanced the laser output 105, formed as part of, or affixed to, the transparent planar face 50 are a plurality of discreet elements 64*a* & 64*k*. The discreet elements 64*a* & 64*k* are oriented in the planar face 50 so that they may be rotated in-line with the laser output 104.

The laser output 104 may be diffused and formed into a wide variety and type of shapes and patterns specific to the characteristics of the discreet elements 64*a* & 64*k*. The exact degree of pattern forming or diffusion of the output is dependent on the intended use. For the present device 40 a series of plastic diffusion elements and interference pattern generating gratings form the discreet elements 64*a* & 64*k*.

Material choice for the discreet elements 64*a* & 64*k* include convex lenses, concave lenses, conical lenses, magnifying lenses, condensing lenses, Fresnel lenses, diffusion lenses, interference pattern generating gratings, cross-hair generator lens, straight line generator lenses, pattern generator lenses, diffractive pattern generators, holographic diffusers, optical diffusion glass, optical diffusion plastic, diffusion filters, circular diffusers, elliptical diffusers, off-axis lenses, off-axis holographic filters, or off-axis holographic diffusers all yield controllable and selectable results.

The light bulb 201 in this embodiment is Xenon or Halogen gas filled, however, it is envisioned that other types of light sources all well known in the art may be used. In this embodiment four batteries placed parallel in rows of two are connected in series. A rear contact strip 65 affixed at the rear end of the upper chamber 41*a*. The flashlight battery positive terminal 156 and the negative terminal (not shown) abut the light bulb guide contacts 157. The simple pressure circuit is known art and is completed by urging the light bulb back within the light bulb guide 200 until it contacts with the positive and negative terminals. A spacer spring 202 surrounds the light bulb 201 and is compressed by the action of tightening the lens cover 49 onto the housing 41 which pushes the reflector dish 203 against the light bulb.

Referring now to FIG. 3B, there is illustrated a rear cut away, along line A—A, view of the embodiment of FIG. 3A, generally designated 40.

Within the upper chamber 41*a* are the two ends 150*a* & 150*b* of the two rows of batteries powering the flashlight are connected at the rear via the rear contact strip 65.

The plurality of raised ribs 56 are evenly spaced around the outer surface of the annular circular wall 51 to enhance ease of rotation of the lens cover 49.

Referring now to FIG. 2C, there is illustrated a front view of the embodiment of FIG. 3A generally designated 40.

Formed within the planar face 50 are a plurality of discreet elements 64*a* & 64*k*. Between each discreet element 64*a* & 64*k* is the transparent planar face 50 material which allows the un-enhance laser output 104 to pass from the device. When used in concert, the light bulb 201 produces a generalized wide spectrum illumination and the laser output, exiting the housing through the laser beam guide 205, produces the precise shaped pattern or pin-point illumination within the area of generalized illumination.

Since certain changes may be made in the above apparatus without departing from the scope of the invention herein involved, it is intended that all matter contained in the above description, as shown in the accompanying drawing, shall be interpreted in an illustrative, and not a limiting sense.

What is claimed is:

1. A laser light, comprising:

(a) a casing;

(b) a first laser emitting source and second laser emitting source each having a fixed orientation within the casing;

(c) a first laser emission in substantially the red spectral region emitted by said first laser emitting source and a second laser emission in substantially in the blue/green spectral region emitted by said second laser emitting source; and, (d) a rotatable lens coupled to an end of the casing, the lens including at least one pair of beam altering elements forming groups of beam altering pairs, where by each laser emitting source emits through one of the pair of beam altering elements, either independently or in concert.

2. The laser light of claim 1, wherein passage of said first laser emission through the first member of said beam altering pair results in a pinpoint laser output and passage of said second laser emission through the second member of said beam altering pair results in a diffuse laser output whereby during simultaneous emission a blue/green spot light results with a red targeting pinpoint therein.

3. The laser light of claim 1, further comprising an adjustable weapons mount.

4. The laser light of claim 3, further comprising and "X" and "Y" axis adjustment on said first laser emitting source whereby the "X" and "Y" aspects of said first laser emission may be adjusted.

5. The laser light of claim 1, wherein passage of said first laser emission through the first member of said beam altering pair results in a crosshair laser output and passage of said second laser emission through the second member of said beam altering pair results in a diffuse laser output, whereby during simultaneous emission a blue/green spot light results with a red targeting crosshair therein.

6. A handheld laser flashlight, comprising;

(a) a casing having an open front end;

(b) an illumination source, mounted within the casing;

(c) at least one laser emitting source, mounted within the casing;

(d) a power source, mounted within the casing and powering the illumination source and the laser emitting source;

(e) a front cover, coupled to the open end of the casing, wherein the illumination source and the laser emitting source emit through the front cover; and, (f) a rotatable lens coupled to said front cover, the lens including at least one beam altering element, wherein the illumination source emit through the rotatable lens and the laser emitting source may selectively emit through the rotatable lens.

7. The handheld laser flashlight of claim 6, further comprising an adjustable weapons mount affixed to said casing.

8. A laser and full-spectrum illumination and targeting device, comprising;

(a) a casing;

(b) a power supply mounted within said casing;

(c) an illumination source, mounted within the casing;

(d) a first laser emitting source and a second laser emitting source each having a fixed orientation mounted within the casing;

(e) a first laser emission in substantially the red spectral region emitted by said first laser emitting source and a second laser emission in substantially in the blue/green spectral region emitted by said second laser emitting source; and (f) a rotatable lens coupled to an end of said casing, the lens including at least one pair of beam altering elements forming groups of beam altering pairs, whereby each laser emitting source emits through one of the pair of beam altering elements, either independently or in concert.

9. The laser and full-spectrum illumination and targeting device of claim 8, wherein the passage of said first laser emission through the first member of said beam altering pair results in a pinpoint laser output and passage of said second laser emission through the second member of said beam altering pair results in a diffuse laser output, whereby during simultaneous laser emissions a blue/green spot light results with a red targeting pinpoint therein.

10. The laser light of claim 8, further comprising an adjustable weapons mount.

11. The laser light of claim 9, further comprising an "X" and "Y" axis adjustment on said first laser emitting source whereby the "X" and "Y" aspects of said first laser emission may be adjusted.

12. The laser light of claim 8, wherein passage of said first laser emission through the first member of said beam altering pair results in a crosshair laser output and passage of said second laser emission trough the second member of said beam altering pair results in a diffuse laser output, whereby during simultaneous emission blue/green spot light results with a red targeting crosshair therein.

* * * * *